United States Patent [19]

Frahm

[11] 4,359,021

[45] Nov. 16, 1982

[54] RECOIL STARTER

[75] Inventor: James H. Frahm, Oshkosh, Wis.

[73] Assignee: Brunswick Corporation, Skokie, Ill.

[21] Appl. No.: 109,035

[22] Filed: Jan. 2, 1980

[51] Int. Cl.[3] ..... F02N 3/02

[52] U.S. Cl. ..... 123/185 BA; 123/185 A

[58] Field of Search ..... 123/185 A, 185 B, 185 BA, 123/185 C, 185 CA, 185 R

[56] References Cited

U.S. PATENT DOCUMENTS

| | | | |
|---|---|---|---|
| 2,597,334 | 5/1952 | Johnson et al. | 123/185 BA |
| 2,848,987 | 8/1958 | Morden | 123/185 BA |
| 3,127,884 | 4/1964 | Rice | 123/185 BA |
| 3,730,162 | 5/1973 | Murase | 123/185 BA |
| 4,127,098 | 11/1978 | Frers et al. | 123/185 A |
| 4,149,510 | 4/1979 | Koga et al. | 123/185 A |

*Primary Examiner*—Charles J. Myhre
*Assistant Examiner*—Andrew M. Dolinar

[57] ABSTRACT

A recoil starter (10) for mounting in concentric alignment with the driven member (14) of an internal combustion engine (15) includes a starter housing (11), a starter sheave (12), a pull rope (13) wrapped around the sheave (12) and means to rewind the pull rope (22). A pawl (26) having a standby position and an engaged position is pivotally mounted on the starter sheave (12). The pawl (26) has a first end (34) and a second end (37) and a pawl engaging means (17) which pivots the pawl (26) to engage the first end (34) with the driven member (14) to rotate the driven member (14).

1 Claim, 8 Drawing Figures

FIG. 1
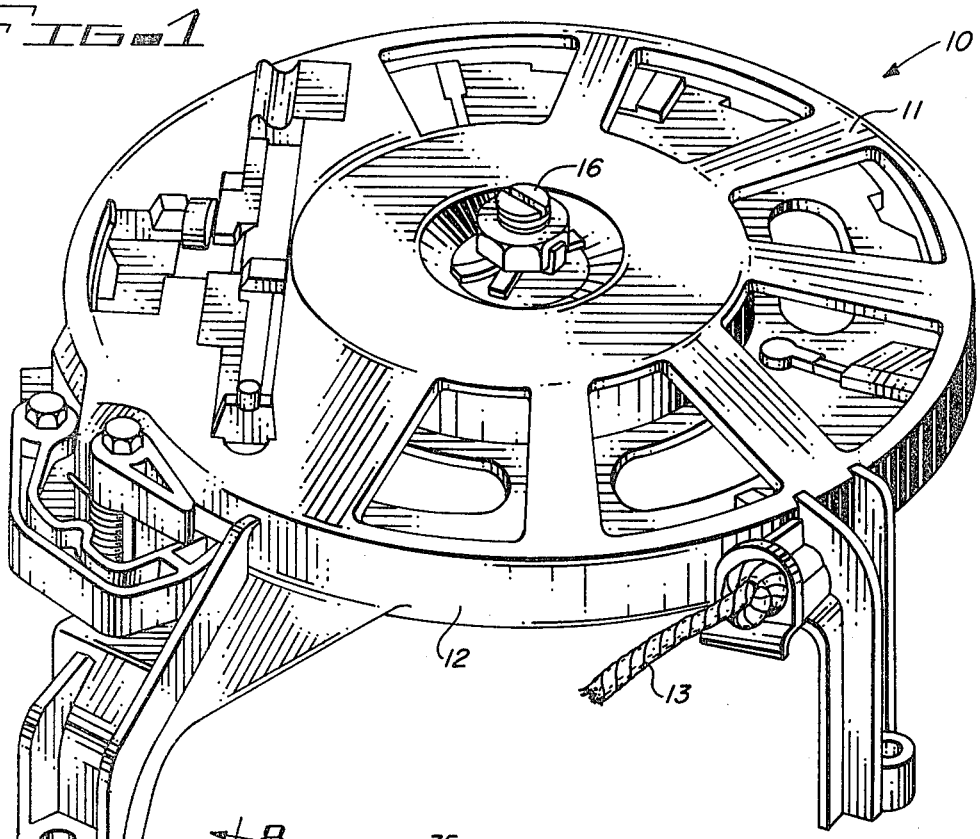
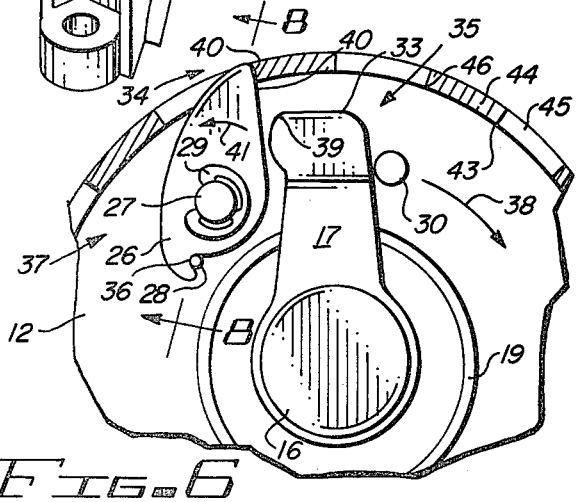
FIG. 6
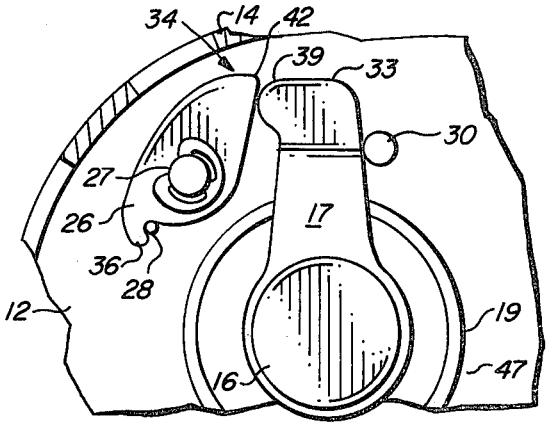
FIG. 5
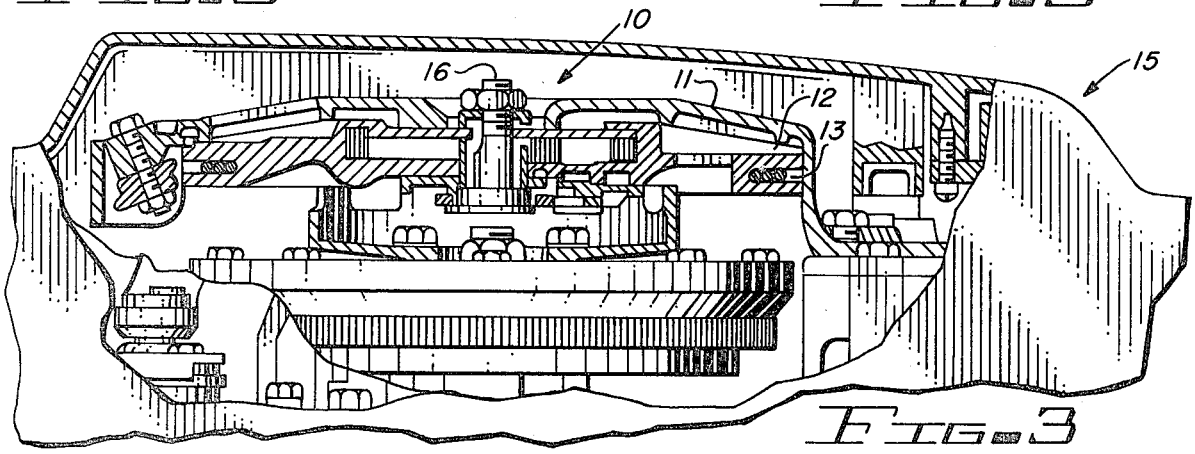
FIG. 3

FIG. 2
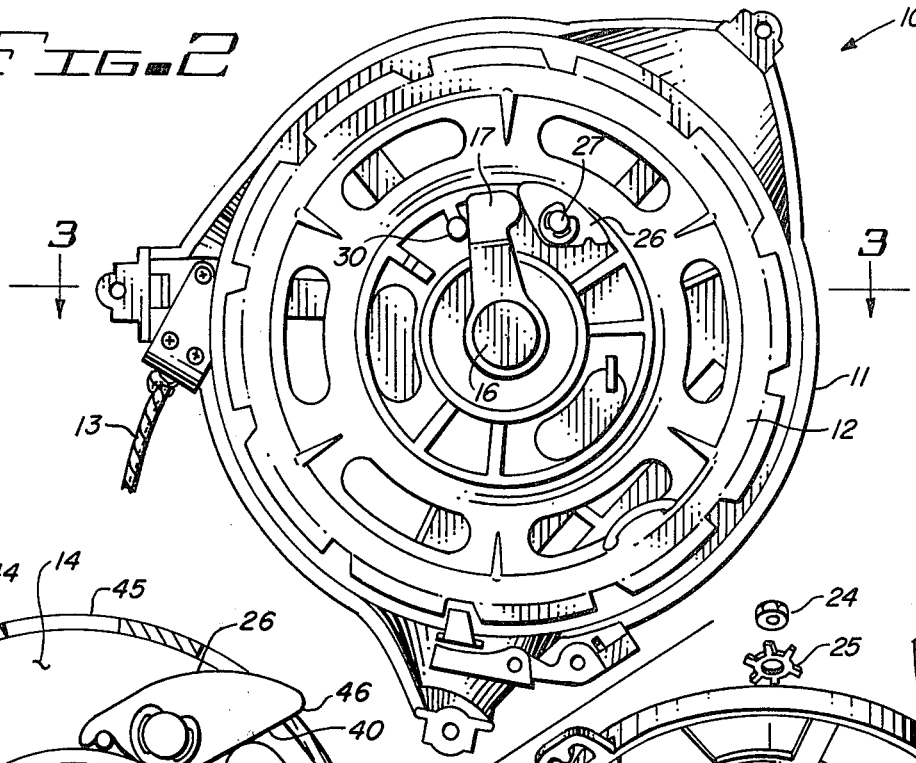
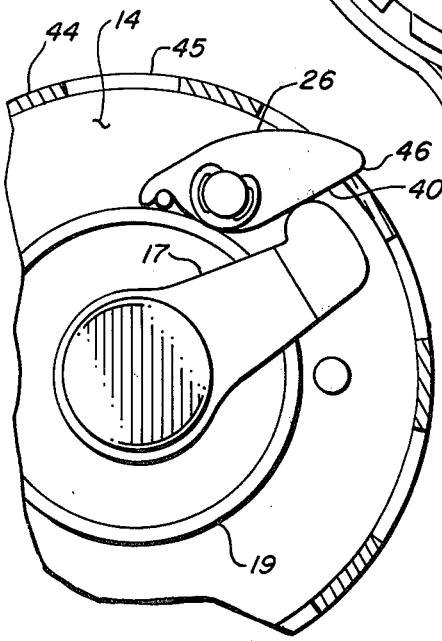
FIG. 7
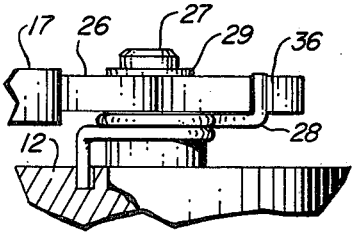
FIG. 8
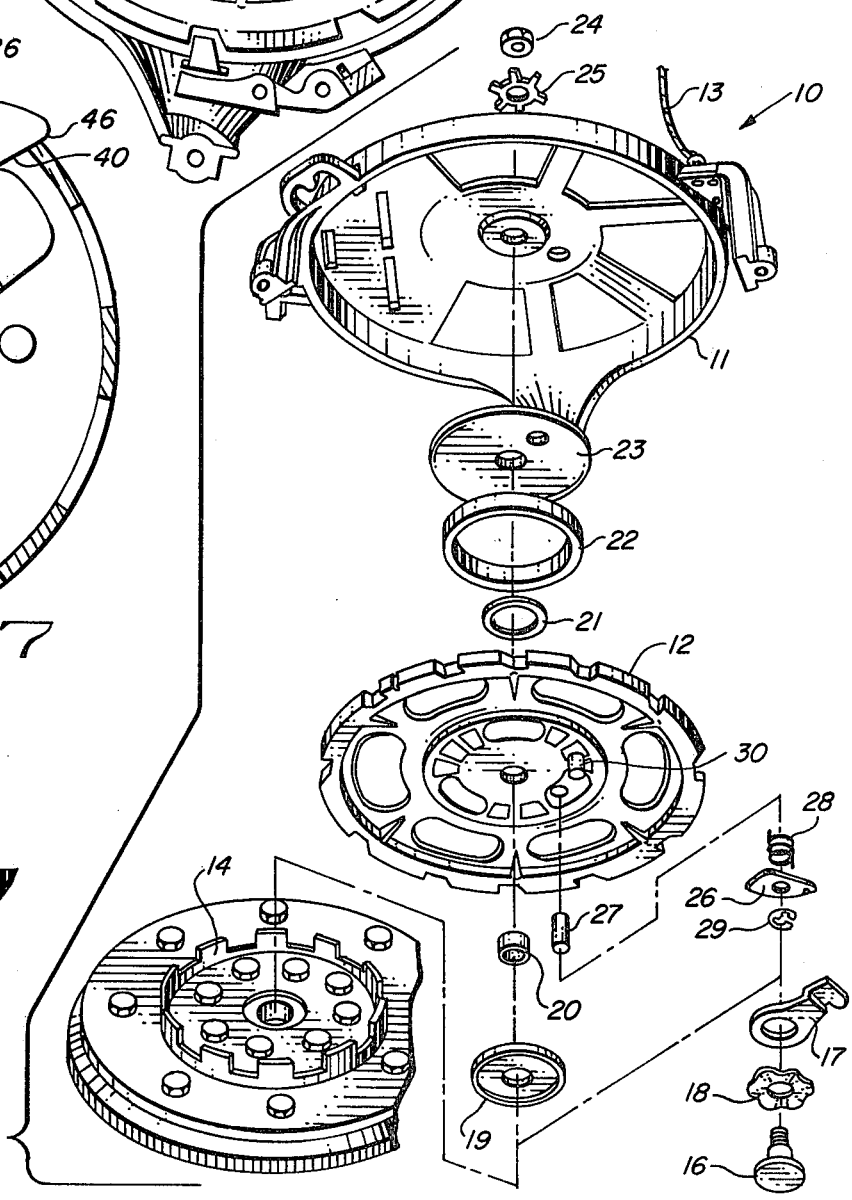
FIG. 4

RECOIL STARTER

DESCRIPTION

Technical Field

This invention relates to a recoil starter for an internal combustion engine and particularly concerns a pawl operated recoil starter.

Background Art

Recoil starters operated with pull ropes are known for starting small internal combustion engines. In a prior recoil starter three starter pawls are extended and retracted by rotating a plate having dual cam surfaces. In this recoil starter it is difficult to maintain the three pawls all engaged. If one pawl is not properly engaged it can vibrate, contact the ratchet wheel and be damaged resulting in a non-operational starter.

Disclosure of Invention

Applicant's recoil starter includes a starter housing for mounting in concentric alignment with a driven member of an internal combustion engine. A starter sheave is rotationally positioned on a center pivot within the starter housing and a pull rope is wrapped around the starter sheave. A pawl having a standby position and an engaged position is pivotally mounted on the starter sheave. The pawl has a first end and a second end and a pawl engaging means which pivots the pawl to engage the first end with the driven member to cause the starter sheave and the driven member to rotate together until the engine starts. Applicant's recoil starter utilizes a single pawl and a single pawl engaging means to provide positive engagement of the pawl as well as reliable, repeatable engine starting. In addition, applicant's recoil starter contains fewer number of parts than other recoil starters providing simplicity and economy in manufacture.

BRIEF DESCRIPTION OF DRAWINGS

FIG. 1 is a perspective elevational view of a recoil starter for an internal combustion engine.

FIG. 2 is the recoil starter shown in FIG. 1 as viewed from the bottom portion which mounts adjacent the engine.

FIG. 3 is a sectional view of the recoil starter of FIG. 1 and illustrates it mounted on an internal combustion engine.

FIG. 4 is an exploded view illustrating the relationship of the parts of the recoil starter.

FIG. 5 is a top elevational partially sectional illustration of the starter in standby starting position.

FIG. 6 is the same as FIG. 5 with the starter in engine starting position.

FIG. 7 is the same as FIG. 5 with the engine just starting.

FIG. 8 is a partial side view of the starter of FIG. 1 illustrating the pawl portion.

BEST MODE FOR CARRYING OUT THE INVENTION

In FIGS. 1 and 2 a recoil starter 10 includes a starter housing 11, a starter sheave 12, and a pull rope 13. The recoil starter 10 is mounted in concentric alignment with a driven member or ratchet wheel 14 on an internal combustion engine 15 as shown in FIG. 3.

Referring to FIG. 4 the starter sheave 12 is shown removed from the starter housing 11. A center pivot or shoulder screw 16 retains a pawl engaging means or lever 17, a friction means or wave washer 18, a circular member or stop 19, a spacer 20, the starter sheave 12, a washer 21, means for rewinding the rope 22, and a retainer 23 on the starter housing 11. A nut 24 and lock washer 25 are positioned on the threaded portion of the shoulder screw 16 to retain the shoulder screw 16 fixed in the starter housing 11.

A pawl 26 is pivotally mounted on a pivot 27 extending outward from the sheave 12 as shown in FIG. 2. In FIG. 4 and FIG. 8 a pawl positioning means or torsion spring 28 is shown positioned over the pivot 27 with a first end engaging the sheave 12; the pawl 26 is positioned over the pivot 27 with the second end of the torsion spring 28 engaged with the pawl 26. A retaining ring 29 holds the pawl 26 on the pivot 27. The starter sheave 12 also has an integral lever stop 30. When the recoil starter 10 is positioned on an engine the shoulder screw 16 is in axial alignment with the axis of the ratchet wheel 14 as shown with the exploded axial line 31 at the bottom of FIG. 4. The relationship of the pawl 26, lever 17, stop 19, and lever stop 30 is also illustrated in FIG. 2.

Engine In Standby Starting Position And Engine Running Position

In the standby and engine running position of the recoil starter 10 as shown in FIG. 5 the forward portion 32 of the end 33 of the lever 17 is in contact with and adjacnet a first end 34 of the pawl 26 and the rearward portion 35 of the lever 17 is in contact and adjacent with the lever stop 30. The torsion spring 28 has an end hooked into a notch 36 in the second end 37 of the pawl 26 to maintain the pawl 26 tensioned in counterclockwise rotation with the first end 34 in contact with the forward portion 32 of the lever 17.

Engine During Starting

In the starting position of the recoil starter 10 as shown in FIG. 6 pulling the pull rope 13 immediately rotates the starter sheave 12 in a clockwise direction as shown by the arrow 38. During the initial rotation of the sheave 12 the lever 17 remains fixed relative to the starter housing 11 and shoulder screw 16. Since the lever 17 is fixed, rotation of the sheave 12 causes the forward portion 32 to contact the first end 34 of the pawl 26. Upon contact with the pawl 26 the rounded surface 39 of the forward portion 32 slides on a ramped surface 40 of the first end 34 of the pawl 26 to rotate the pawl 26 in a counterclockwise direction as shown by the arrow 41. The outer tip 42 of the first end 34 of the pawl 26 will move outward until it either contacts the inner periphery 43 of the ratchet tooth 44 in the ratchet wheel 14 or until it falls into a ratchet space 45 in the ratchet wheel 14. If the outer tip 42 first contacts the inner periphery 43 it will slide until it falls into a ratchet space 45. Once the outer tip 42 falls within the ratchet space 45 the forward portion 32 drives against the counterclockwise edge 46 of the ratchet tooth 44 and the second end 37 contacts the outer periphery 47 of the stop 19. Continued clockwise rotation causes the lever 17 to overcome the friction of the wave washer 18 holding it fixed to the shoulder screw 16 and to rotate with the starter sheave 12. Therefore as long as the pull rope 13 is pulled the rounded surface 39 maintains contact with the ramped surface 40. Since the pawl 26 is engaged with the ratchet wheel 14, the starter sheave 12 and the ratchet wheel 14 rotate as a single unit.

Engine Started

In the engine started position of the recoil starter 10 as shown in FIG. 7, once the engine starts the ratchet wheel 14 begins to rotate in a clockwise direction faster than the clockwise rotation of the starter sheave 12. This causes the first end 34 of the pawl 26 to slide radially inward out of engagement with the counterclockwise edge 46 of the ratchet tooth 44. The sliding out of engagement of the pawl 26 is caused by the clockwise tension on the pawl 26 exerted by the torsion spring 28. Upon the starting of the engine the pull rope 13 is released causing the starter sheave 12 to be rewound by the means for rewinding the rope 22. Immediately upon rewinding the counterclockwise rotation of the starter sheave 12 causes the rearward portion 35 of the lever 17 to contact the lever stop 30. The relationship of the pawl 26, lever 17, starter sheave 12 and lever stop 30 are now the same as shown in the standby starting position in FIG. 5. This relationship is maintained during continued rewinding of the pull rope 13 on the starter sheave 12.

Engine Fails To Start

If the engine fails to start the movement of the pawl 26 and lever 17 are the same as described for the engine starting except that instead of the pawl 26 falling out of engagement with the ratchet space 45 by the overspeeding of the ratchet wheel 14 the pawl 26 falls out of engagement by the release of the pull rope 13 and the counterclockwise rotation of the starter sheave 12 with respect to the reatchet wheel 14 caused by rewinding of the rope 13 by the means for rewinding the rope 22. Repeated pulling of the rope 13 and rewinding of the rope 13 cause a repeated engagement and disengagment of the pawl 26 as previously described.

I claim:

1. A recoil starter for mounting in concentric alignment with a driven member of an internal combustion engine comprising:

(a) a starter housing for supporting said starter on said engine (b) a starter sheave rotationally positioned on a center pivot (c) a pull rope wrapped around said starter sheave (d) means for rewinding said rope around said starter sheave (e) a pawl having a first end and a second end pivotally mounted on said sheave (f) a pawl engaging means to pivot said pawl to engage said first end with said driven member whereby said sheave and said driven member rotate together until said engine starts (g) pawl positioning means to maintain said pawl in a standby position, said pawl positioning means including, a torsion spring positioned around the pawl pivot having a first end fixed with respect to said sheave and a second end tensioned with respect to said pawl to rotationally maintain said pawl in said standby position.

* * * * *